US012753967B2

(12) United States Patent
Modi et al.

(10) Patent No.: US 12,753,967 B2
(45) Date of Patent: Oct. 6, 2026

(54) HOUSEHOLD COOLING APPLIANCE CONTAINING A SPECIFICALLY CONFIGURED PLATE-LIKE SEPARATION UNIT IN A RECEIVING SPACE

(71) Applicant: BSH Hausgeräte GmbH, Munich (DE)

(72) Inventors: Ashish Modi, Istanbul (TR); Oguz Kaan Gür, Neu-Ulm (DE); Altug Karabas, Ulm (DE); Tobias Mayr, Gundelfingen an der Brenz (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 18/828,091

(22) Filed: Sep. 9, 2024

(65) Prior Publication Data

US 2025/0085047 A1 Mar. 13, 2025

(30) Foreign Application Priority Data

Sep. 8, 2023 (TR) ..... 2023/011179

(51) Int. Cl.
*F25D 27/00* (2006.01)
*F25D 23/06* (2006.01)
*F25D 25/02* (2006.01)

(52) U.S. Cl.
CPC ..... *F25D 27/005* (2013.01); *F25D 23/061* (2013.01); *F25D 23/065* (2013.01); *F25D 23/069* (2013.01); *F25D 27/00* (2013.01); *F25D 25/02* (2013.01); *F25D 2325/022* (2013.01)

(58) Field of Classification Search
CPC .. F25D 27/005; F25D 27/00; F21W 2131/305
See application file for complete search history.

(56) References Cited

U.S. PATENT DOCUMENTS 8,215,795 B2 * 7/2012 Pichel ..... F21V 33/0012 362/249.02
9,995,477 B2 6/2018 Miedema et al.
2014/0376213 A1 * 12/2014 Miedema ..... F21V 5/04 362/127
2016/0327259 A1 11/2016 Pan
2020/0355425 A1 * 11/2020 Fei ..... F21V 23/045
2021/0330081 A1 * 10/2021 McMillin ..... A61L 2/10

FOREIGN PATENT DOCUMENTS

CN 1959313 A 5/2007
CN 101240974 A 8/2008

* cited by examiner

*Primary Examiner* — William N Harris
(74) *Attorney, Agent, or Firm* — Laurence A. Greenberg; Werner H. Stemer; Ralph E. Locher

(57) ABSTRACT

A household cooling appliance contains a housing and a first receiving space for food configured in the housing. A plate-like separation unit, which is releasably arranged in the first receiving space, is arranged for separation of the volume of the first receiving space. The separation unit contains a base plate, wherein on the bottom side of the base plate a module carrier is arranged for receiving a function module of the separation unit, which is a light module. The light module is releasably arranged to be sunk in a receptacle of the module carrier at least in part and is held therein by a fixing connection.

16 Claims, 6 Drawing Sheets

HOUSEHOLD COOLING APPLIANCE CONTAINING A SPECIFICALLY CONFIGURED PLATE-LIKE SEPARATION UNIT IN A RECEIVING SPACE

CROSS-REFERENCE TO RELATED APPLICATION

This application claims the priority, under 35 U.S.C. § 119, of Turkish Patent Application TR 2023/011179, filed Sep. 8, 2023; the prior application is herewith incorporated by reference in its entirety.

FIELD AND BACKGROUND OF THE INVENTION

An aspect of the invention relates to a household cooling appliance containing a housing with a receiving space for food configured in the housing. Moreover, the household cooling appliance contains a plate-like separation unit, which is releasably arranged in the receiving space. The plate-like separation unit according to the intended purpose is moreover also arranged for separation of the volume of the receiving space. The separation unit contains a base plate.

By such divisional plates it is moreover facilitated that they serve as deposit plate, on the top side of which objects, such as also food, may be deposited. Thus, such divisional plates are also multi-functional units, which in this regard may be used in manifold ways.

From U.S. Pat. No. 9,995,477 a plate-like separation unit in a cooling compartment of a household cooling appliance is known. There a multi-component setup of the separation unit is provided. Components may for instance also be arranged by a double-sided adhesive tape on the bottom side of the base plate.

SUMMARY OF THE INVENTION

It is an object of the present invention to provide a household cooling appliance, in which a plate-like separation unit is configured to comprise multiple components and the individual components are connected with each other in needs-based manner.

This object is solved by a household cooling appliance, which comprises the features according to the independent claim.

An aspect of the invention relates to a household cooling appliance containing a housing with a receiving space for food configured in the housing. Moreover, the household cooling appliance contains a plate-like separation unit, which is releasably arranged in the housing. The plate-like separation unit moreover according to the intended purpose is also arranged for separation of the volume of the receiving space. The separation unit contains a base plate. The separation unit may also be referred to as divisional plate. On the bottom side of the base plate is arranged a module carrier for receiving a function module that is a light module. The light module is releasably arranged on the module carrier. The module carrier comprises a receptacle, in which the light module is arranged to be sunk at least in part and is held therein by a fixing connection. Thus, the light module can be easily fastened to the glass plate, namely indirectly via the module carrier, and the light module is also arranged to be protected. The light module may be arranged to be completely sunk in in the receptacle and flat with the base carrier of the module carrier. Thus, the light module may also be installed without contacting this base plate. Here, too, it is then facilitated that no other fastening elements, such as screws or the like, are required for the light module to directly install this light module on the base plate, which is in particular a glass plate. Since the fastening of a light module by an adhesive bond directly to the glass plate also due to thermal aspects may be disadvantageous, the implementation with a module carrier that is separate from the light module is particularly advantageous. This is because then it is also facilitated that the light module can be fastened by other fastening options directly to the module carrier. Accordingly, it is possible that the light module for instance is fastened to the module carrier. It is particularly advantageous if the light module is fastened by at least one or several snap-fit structure to the module carrier. It is then also facilitated that only by these fixing connections the fastening of the light module to the module carrier is provided. A particularly simple mounting and demounting is then achieved. The latching structures of the light housing may be provided as a plurality of projection or detent springs facing outwardly provided on an outer side surface of the light housing, which, in the latched state, engaging with a catching structure formed as groove or depression on an inner side surface of the receptacle of the module carrier, preferably the latching structure is correspondingly shaped to the catching structure.

In an embodiment, the separation unit may comprise a bar-like front panel that is separate from the base plate. This front panel is held by a releasable connection to the module carrier. Thus, the module carrier serves as multi-component carrier. This is because in addition to the receptacle of a function module that is provided according to the intended purpose it is also provided for mechanically holding the front panel. Thus, it is facilitated that the front panel, viewed per se, need not be fastened otherwise, for instance by an adhesive tape or the like, to another component, such as in particular the base plate. By the direct mechanical coupling of the front panel to the module carrier also a simpler mounting process is facilitated. In particular, arranging the front panel in very precise position is also facilitated. This position preferably can also be permanently maintained. Especially for a front panel this is particularly advantageous, since it represents a visible component of the separation unit at the front side. For this reason, the position of the front panel with regard to precision relative to other components is particularly brought into focus. By the suggested concept this may be realized accordingly.

In an embodiment, the releasable connection contains at least one snap-fit connection. Such a connection is very easily also reversibly releasable and restorable. Not least, it is mechanically also very stable and robust. Especially the permanent arrangement of the front panel in fixed position is thereby very advantageously achievable. In particular, it is therefore also facilitated that no additional separate fastening elements, such as for instance an adhesive tape or the like, are required.

In an embodiment, the snap-fit connection comprises at least one snap-fit claw, which is provided for receiving a snap-fit bolt of the snap-fit connection. The snap-fit connection may in an embodiment also comprise at least one such snap-fit bolt, which is provided for snap-fitting in the snap-fit claw. In the snap-fitted state of the snap-fit claw with the snap-fit bolt the snap-fit connection is configured. A snap-fit claw and a snap-fit bolt in the snap-fit state facilitate a particularly stable mechanical design and also holding. Precisely when the front panel does not comprise any further mechanical connection provided for holding the front panel, by such snap-fit connections also the then cantilevered holding of the front panel may be achieved and maintained.

In an embodiment, the snap-fit claw, viewed in a cross section, is C-shaped. The snap-fit bolt in an example of an embodiment in its outer contour is preferably configured complementary to the inner contour of the snap-fit claw. Thus, also a particularly precisely fitting and form-fitting insertion of the snap-fit bolt into the snap-fit claw is facilitated. The particularly stable tolerance-free design of the snap-fit connection is thereby facilitated. The snap-fit bolt in a cross-section in the portion provided for insertion into the snap-fit claw, may be configured to be corner-free. In particular this applies to the shape of the contour of the snap-fit bolt.

In an embodiment, the snap-fit claw is integrally formed on the module carrier. This means that the snap-fit claw is manufactured to be integrally formed with the module carrier. In an embodiment the snap-fit bolt is integrated in the front panel. This means that the snap-fit bolt is configured to be integrally formed with the front panel. The corresponding association between the concrete elements of the snap-fit connection with the concrete components of the separation unit, in turn, also entails advantages in mounting. This is because then the front panel can be moved to the module carriers, which are already mounted in precise location on the base plate, and the snap-fit bolt may be easily snap-fitted into the snap-fit claw. By the integration of the named elements of the snap-fit connection into the respective components module carrier and front panel also the number of components may be reduced. Additional mounting effort for the snap-fit bolt or the snap-fit claw on the respective named components can thereby be avoided. Also position tolerances can thereby be considerably minimized.

The base plate is in particular a solid plate in itself. In particular the base plate in its entire portion is configured to be made homogenously from the same material. In an embodiment the base plate is formed without any cavities. It is in particular configured to be integrally formed. In particular it is no thermal insulation plate, which comprises a clearance, in which separate, thermally insulating material is inserted. Thus, in the present embodiment for instance also a glass plate is not an otherwise also known thermal insulating plate. It therefore does not comprise any clearance, in which thermally insulating material is arranged, which is enclosed or enveloped, respectively, by a ceiling wall and a bottom wall that are separate thereto.

In an embodiment, the base plate is a glass plate. This means it is then in particular only formed by the glass plate. Especially in such a design, with the suggested concept it is very advantageously facilitated that on the glass plate itself no further fastening elements need to be provided in order to be able to fasten the front panel directly to the glass plate. Thus, drillings or recesses in the glass plate for fastening the front panel directly thereon can be avoided. In order to provide an appropriate appearance for the user, the glass plate may be provided opaque at least at the area of the module carrier.

In an embodiment, the module carrier is fastened to the bottom side of the base plate by an adhesive bond arranged along a flange surface of the module carrier. At the interface this adhesive bond is very advantageous. This is because no additional elements, such as screws or the like, need to be installed. This is particularly then advantageous, if the base plate is a glass plate. Same may then be provided without through holes or without generating recesses or cut-outs. This is advantageous especially in the manufacture of glass plates. An adhesive bond may for instance be a double-sided adhesive tape, which is arranged between the flange surface of the module carrier and the base plate. The flange surface may extend horizontally or in parallel to the base plate. The module carrier may comprise horizontal flange surfaces extending along the longitudinal sides of the module carrier and forming a flat surface on which is provided the adhesive bond for attaching the module carrier to the lower side of the base plate. Thus, the module carrier may be arranged in precise and permanently fixed position. In order to avoid that the module carrier is visible through the glass plate, the glass plate is at least made opaque at the area of the module carrier, for example by glass coating or semi-transparent glass.

Not only in the example, but also in general, the module carrier may be configured as housing for the function module, here the light module, which may also comprise a own separate module light housing.

In an embodiment, the light module comprises a circuit board. Thereon at least one light source is arranged. The light source may for instance be a light-emitting diode. The circuit board is arranged in a light housing of the light module. In particular this light housing of the light module may comprise the above-named fixing connection, by which then the light housing of the light module is fastened to the module carrier, which is separate thereto. The light housing may be pot-shaped having a bottom wall, forming the light transmission plate, from which extending vertical walls forming a cavity for receiving the circuit board, which is, in the mounted state, snapped between inner detent springs facing inwardly and vertical rips provided along the inner side surface of the cavity of the light housing.

In an embodiment, the light housing of the light module is configured to be translucent or transparent at least in part, in particular in the portion in which according to the intended purpose the light of the light source is meant to exit from the light module. It may be envisaged that this light housing contains a diffusor. In particular the diffusor may be integrally formed with the light housing. The diffusor may have a coating, surface treatment/roughening, or particles in order to scatter the light. By a diffusor the emission of the light of the light source is correspondingly scattered so that also a more homogenous distribution of light is facilitated.

In an embodiment, the module carrier on a bottom side comprises at least one light opening. In particular this is a light exit opening. From same the light of the light module exits, if it is installed on the module carrier.

In an embodiment, a glare protection cover is arranged on the bottom side adjacent to the at least one light opening. In particular this glare protection cover is integrated in the module carrier and thus integrally formed therewith. By such a glare protection cover, which is preferably configured as elongated bar, a shading of the exiting light may be achieved. Thus, a glaring, which blinds the viewers, can be avoided. In particular, thus, also the light module is arranged to be hidden and a direct viewing of the light module or the light source by the viewer is avoided. Thus, it is also achieved that in the case of viewing the household cooling appliance from the front, by this glare protection cover a covering is provided, by which the light module also forms an indirect lighting.

In an embodiment, the module carrier comprises a cable duct, by which cables are laid from the separation unit to externally or from externally to the module carrier. In an embodiment the cable duct is arranged with a film hinge on a base carrier of the module carrier. Thus, the cable duct is also configured to be movable relative to the base carrier and integrally formed therewith. In particular the module carrier as such may be integrally formed. It may for instance be configured to be made of plastic. In particular it may be an injection-molded component. In particular, a cable with a plug from the light module may be guided through the cable duct and connected to a counter plug provided directly adjacent to the module carrier in an opening of the sidewall of the household cooling appliance.

In an embodiment, a method for installing a household cooling appliance contains inserting the light module into the receptacle of the module carrier through the light opening, wherein the light module is positioned in such a manner that the electrical connection of the light module is facing the connection cavity in relation to the longitudinal direction. The method further includes moving the light module in direction of the connection cavity along the longitudinal direction of the receptacle with the result that the electrical connection of the light module is inserted into the connection cavity. One idea that forms the basis of the invention consists in accommodating a light for illuminating the storage compartment of a household cooling appliance in an opening of an elongated receptacle of a module carrier that is arranged outside of the storage compartment. The receptacle has a pocket or a connection cavity in an end region in relation to its longitudinal direction and the connection cavity extends outside of the opening in relation to the longitudinal direction.

The light opening of the receptacle is consequently shorter than the light housing itself with the result that an end region of the light in which an electrical connection is provided can be positioned in the pocket or the connection cavity. As a consequence, this region of the light is not visible from the storage compartment, which improves the aesthetic effect of the illumination.

A further advantage consists in the fact that the light module or light housing can be easily installed in the receptacle of the module carrier, for example in that this light is initially inserted with the electrical connection beforehand into the receptacle of the module carrier in a perpendicular direction, and subsequently along the longitudinal direction into the pocket or the connection cavity.

In accordance with some embodiments, it is possible in this case to provide that the longitudinal direction of the receptacle extends parallel to the transverse direction. In other words, it is therefore possible to provide that the light opening extends longitudinally along the transverse direction. Alternatively or in addition thereto, it is possible to provide that the wall opening is formed in an end region of the ceiling that is facing the rear wall. In accordance with some embodiments, it is possible to provide that the light opening has the shape of a rectangle, wherein a long side of the rectangle extends in the transverse direction. In accordance with some embodiments, it is possible to provide that a length of the light opening in the transverse direction is at least 50 percent, preferably at least 75 percent of a distance between the side walls in the transverse direction.

In accordance with some embodiments, it is possible to provide that the light module and the receptacle are latched to one another via fixing connections that are formed on the light housing and the receptacle. The fixing connections are formed in such a manner that they can lock or can latch to and be detached from one another owing to a relative movement of the light and the receptacle with respect to one another in the longitudinal direction. This means that the fixing connection can be latched by displacing the light housing in the receptacle of the module carrier along the longitudinal direction, for example by displacing the light housing in the direction of the connection cavity. By displacing the light in the receptacle of the module carrier along the longitudinal direction in the opposite direction, it is possible to bring the fixing connection out of engagement again. In accordance with some embodiments, the method can include a latching structure of the light housing to the module carrier during the movement of the light housing along the longitudinal direction in the direction of the connection cavity of the module carrier. Consequently, the installation is further facilitated and a reliable fixing of the light module in the module carrier is simultaneously achieved.

In accordance with some embodiments, it is possible to provide that the latching structures of the light module are formed as detent springs or projections that can deform in an elastic manner, wherein catching structures of the receptacle are formed as depressions or grooves and the projections protrude into the depressions and the depressions have an incline on at least one side in relation to the longitudinal direction along which the projections slide in the case of a movement in the longitudinal direction. The depression can have for example opposite lying edges and a base, wherein the incline extends between the base and one of the edges. In the latched state of the light module inside the receptacle of the module carrier, in each case a projection protrudes into in each case a depression. In order to unlatch the light module and module carrier, it is possible to move the light module along the longitudinal direction in the direction of the incline or in the direction away from the connection cavity. As a consequence, the projection slides on the incline of the depression on the inner side surface of the receptacle of the module carrier and is deformed in an elastic manner by the incline or the acting reaction force, with the result that the projection can be moved out of the depression. This facilitates both the installing as well as the dismantling.

In accordance with some embodiments, it is possible to provide that the latching structures of the light module are configured as a single part with the light module. The light housing can be formed for example from a plastic material. The latching structures can be produced for example together with the light housing or diffusor in a plastic injection molding method.

In accordance with some embodiments, it is possible to provide that the catching structures of the receptacle of the module carrier are formed in receptacle on an inner side surface that extend in the longitudinal direction. The vertical side walls can extend in particular in a transverse manner with respect to the module carrier and delimit the light opening in relation to a width direction that extends in a transverse manner with respect to the longitudinal direction. In particular, the side walls can also extend between receptacle end walls, which lie opposite one another in relation to the longitudinal direction.

In accordance with some embodiments, it is possible to provide that the diffusor of the light housing is formed as a plate that extends in the light opening of the module carrier along the longitudinal direction. The light cover has side parts that lie opposite one another and that extend in a transverse manner with respect to the diffusor and the illuminating facility is fastened to the side parts. The diffusor can be formed for example from a material that is in part transparent for visible light, in particular from a plastic material. The diffusor can be formed from a material that is semitransparent for light, in particular from a plastic material. In general, the diffusor is configured so as to scatter visible light. The diffusor can be arranged lying opposite of light elements, especially LEDs, on the circuit board in order to scatter the light that is emitted from the light elements.

The scattering of the light can be caused for example by corresponding roughening of the surface of the diffusor or particles that are embedded in the diffusor.

The electrical connection may be provided as a plug which is connected to a counter plug before the light module is inserted into the receptacle of the module carrier. Further, the electrical connection may be provided by plug connection after the light module is inserted into the receptacle of the module carrier. In a further embodiment, the electrical connection may be provided by electrical contact pins mounted on the circuit board connected to electrical contact surfaces mounted on the module carrier, or vice versa, after the light module is inserted into the receptacle of the module carrier. In this way, the manufacturing process is provided more efficient and simplified.

By the indications "top", "bottom", "front", "back", "horizontal", "vertical", "depth direction", "width direction", "height direction" the positions and orientations given in the case of intended use and intended positioning of the appliance are indicated.

Further features of the invention derive from the claims, the figures, and the description of the figures. The features and feature combinations previously named in the description, as well as the features and feature combinations named in the following in the description of the figures and/or shown in the figures alone can be used not only in the respectively indicated combination, but also in other combinations or alone, without leaving the scope of the invention. Thus, also implementations of the invention are to be considered as comprised and disclosed, which are not explicitly shown and explained in the figures, however derive from separated feature combinations from the explained implementations and can be generated from them. Also explanations and feature combinations are to be regarded as disclosed, which thus do not comprise all features of an originally formulated independent claim.

Other features which are considered as characteristic for the invention are set forth in the appended claims.

Although the invention is illustrated and described herein as embodied in a household cooling appliance containing a specifically configured plate-like separation unit in a receiving space, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE FIGURES

In the figures identical or functionally identical elements are equipped with the same reference signs.

DETAILED DESCRIPTION OF THE INVENTION

Figure 1:
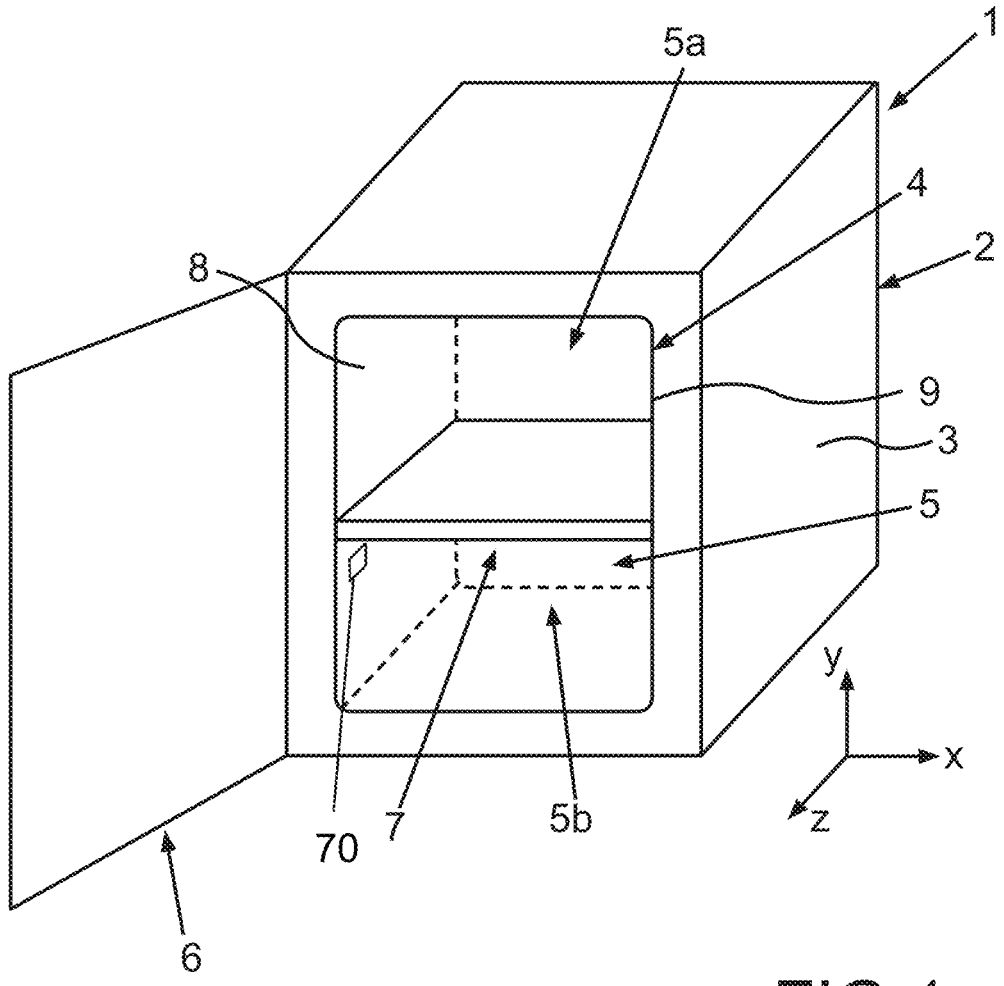
FIG. 1 is a diagrammatic, perspective view of an embodiment of a household cooling appliance according to the invention.

Referring now to the figures of the drawings in detail and first, particularly to FIG. 1 thereof, there is shown a household cooling appliance 1 according to the invention is shown. The household cooling appliance 1 is configured for storing and preserving food. The household cooling appliance 1 may be a cooling appliance or a freezer or a fridge-freezer combination device. The household cooling appliance 1 containing a housing 2. Same comprises an outer housing 3. In the outer housing 3 an inner liner 4 that is separate therefrom is arranged. The inner liner 4 by walls bounds at least one first receiving space 5. The first receiving space 5 may be a cooling compartment or a freezer compartment. Moreover, the household cooling appliance 1 contains a door 6. Same is provided for closing the first receiving space 5. The door 6 is swivably arranged on the housing 2.

Moreover, the household cooling appliance 1 contains a plate-like separation unit 7. Same according to the intended purpose is provided for attachment in the first receiving space 5. The plate-like separation unit 7 is non-destructively releasably arranged in the first receiving space 5. According to the intended purpose, it is provided for separation of the volume of the first receiving space 5. Thereby, in the embodiment here an upper volume subspace 5*a* and a lower volume subspace 5*b* is formed. As can be discerned, the plate-like separation unit 7 extends in the width direction (x) of the household cooling appliance 1 across the entire width of the first receiving space 5. In particular, the plate-like separation unit is arranged on opposite vertical sidewalls 8 and 9 of the inner liner 4. Further, a counter plug 70 is installed in the sidewall 8 for electrical connection.

Figure 2:
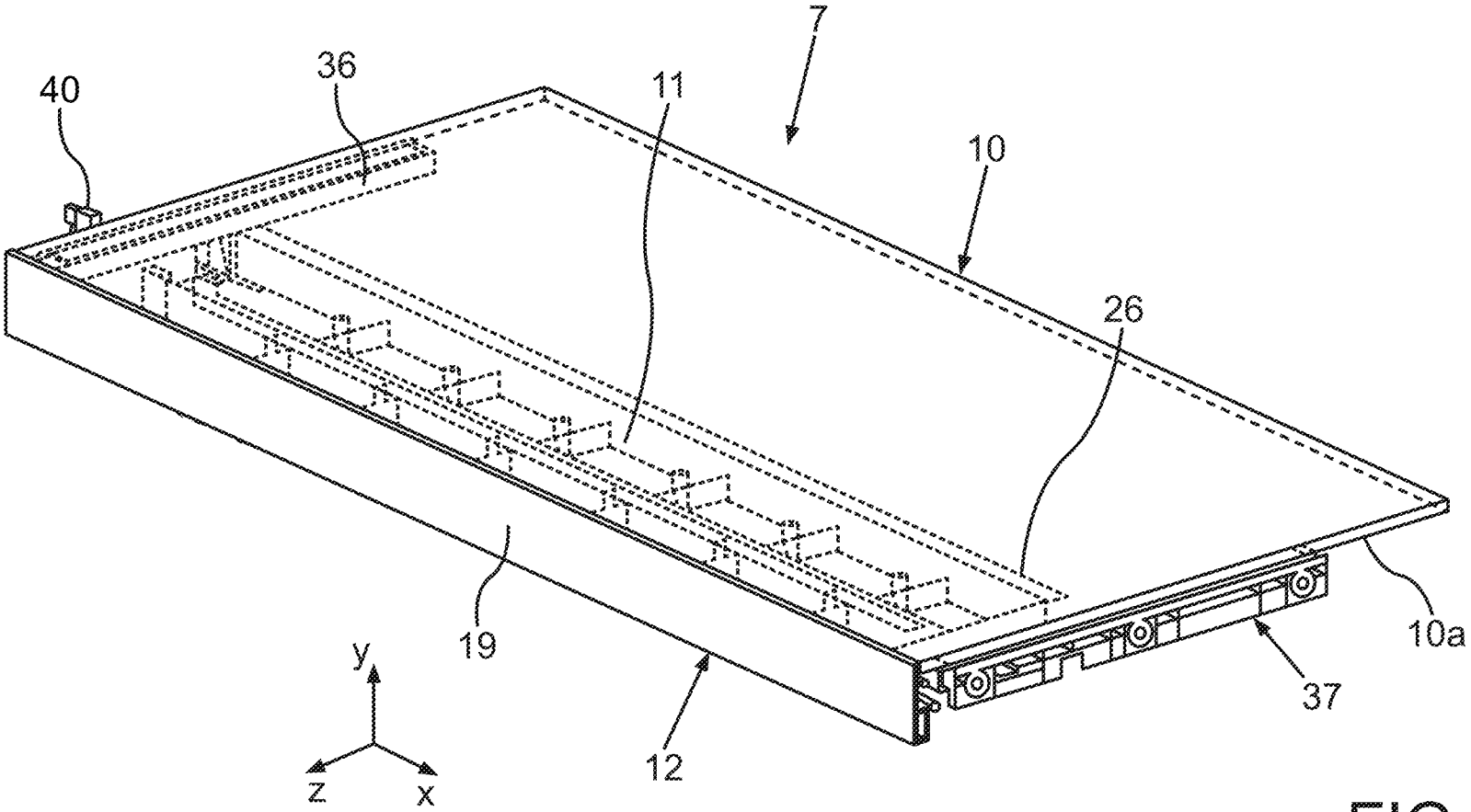
FIG. 2 is a perspective representation of an embodiment of a plate-like separation unit.

In FIG. 2 in a perspective representation an embodiment of the plate-like separation unit 7 is shown. The plate-like separation unit 7 contains a base plate 10. Here, the base plate 10 is a glass plate. It is configured to be transparent at least in part. The base plate 10 is configured only by this one glass plate.

On a bottom side 10*a* of the base plate 10 a module carrier 11 that is separate thereto is arranged. The module carrier 11 is configured for receiving at least one function module of the household cooling appliance 1, in particular the plate-like separation unit 7. Moreover, the plate-like separation unit 7 comprises a base plate 10 and a separate, bar-like front panel 12. As may be discerned, this front panel 12 extends as elongated strip in particular across the entire width of the base plate 10 and entire height of the base plate 10 and module carrier 11, so that in front view the bar-like front panel 12 completely covers the frontside of the base plate 10 and module carrier 11.

Figure 3:
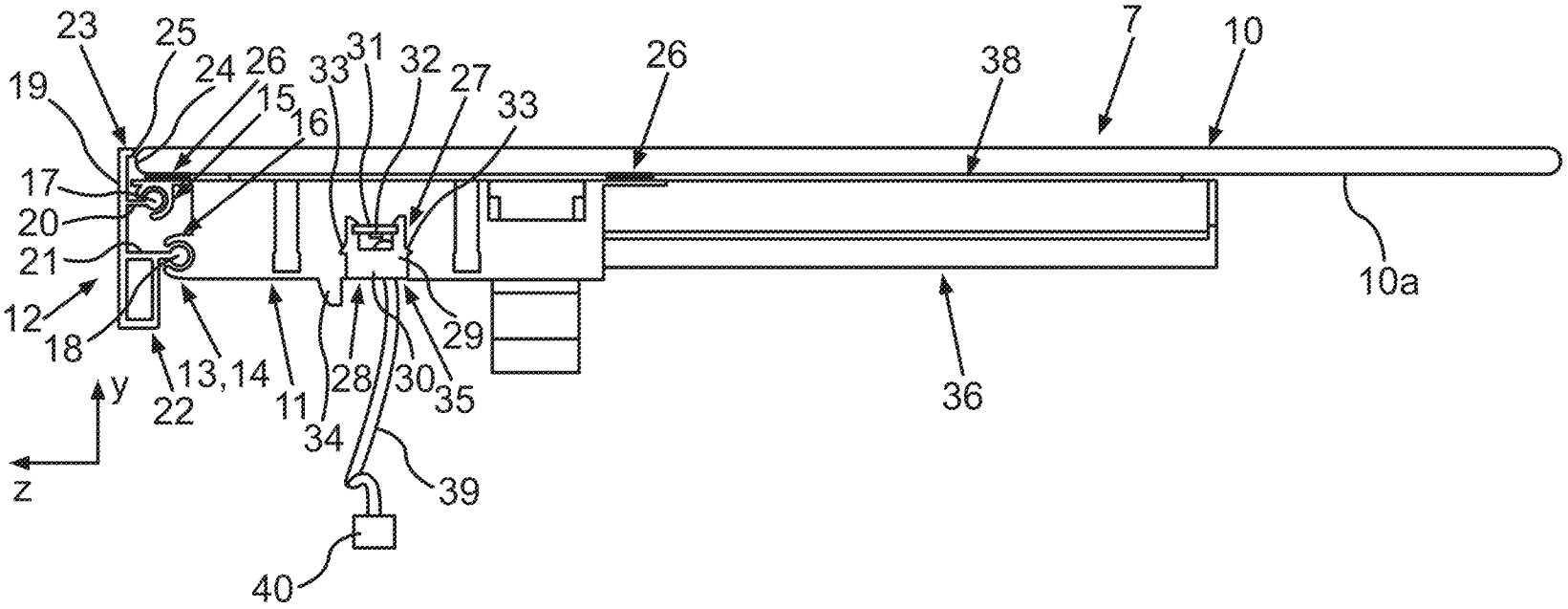
FIG. 3 is a side view of the plate-like separation unit according to FIG. 2.

In FIG. 3 the plate-like separation unit 7 according to FIG. 2 is shown from the side. As may be discerned here, the front panel 12 with a releasable connection 13, in particular a releasable mechanical connection, is directly connected to the module carrier 11. In particular, the module carrier 11 is the component on which the front panel 12 is arranged and held. In particular, the front panel 12 is solely held by this coupling with the module carrier 11. This releasable mechanical connection 13 is preferably a snap-fit connection 14. This snap-fit connection 14 preferably contains at least one first snap-fit claw 15, here two separate first snap-fit claw 15 and second snap-fit claw 16. Moreover, the snap-fit connection 14 contains at least one first snap-fit bolt 17, here two separate first snap-fit bolt 17 and second snap fit bolt 18. In the side view or in the cross-section, respectively, a first snap-fit claw 15 and second snap-fit claw 16 is configured to be C-shaped. Preferably, a snap-fit bolt 17, 18 at least in the portion provided for being received in a snap-fit claw 15, 16, is configured to be rod-shaped and configured with an outer, corner-free contour. In particular a snap-fit bolt 17, 18 is envisaged for accurately fitting insertion into a snap-fit claw 15, 16. In the mounted end state shown in FIG. 3 the snap-fit bolts 17, 18 are snap-fitted in the snap claws 15, 16.

Preferably, the snap-fit bolts 17, 18 are integrated into the front panel 12. They are thus configured to be integrally formed therewith. As may be discerned, the front panel 12 contains a front-side plate-like panel part 19. On its rear side, here preferably first holding fillet 20 and second holding fillet 21 are integrated. On these holding fillets 20, 21 on the end side the snap bolts 17 and 18 are arranged. They are therefore oriented freely cantilevering towards the rear. In particular for stabilization of the front panel 12, in particular of the holding bar 21 that is longer towards the rear, a stabilizing structure 22 is formed. Thus, the panel part 19 is stiffened and a support structure is formed for the holding bar 21. The holding bar 21 therefore is supported from below by this support structure.

In an embodiment, the front panel 12 contains a top, in particular horizontal, top end bar 23. Same extends from the front-side panel part 19 at an angle towards the rear, in particular freely cantilevering. In particular this horizontal top end bar 23 rests from the front against a front edge 24 of the base plate 10. It may be envisaged that the front edge 24 contains a small, groove-like depression 25, into which this top end bar 23 plunges coming from the front. Thus, in an embodiment it is envisaged that the top end bar 23 overlapping in the depth direction (z) with the remaining portion of the front edge 24 extending therefrom in the height direction (y) downward.

As may be discerned moreover in FIG. 3, the snap-fit claws 15 and 16 are preferably configured to be integrated in the module carrier 11. They are thus in particular configured to be integrally formed therewith. As is shown in FIG. 3, the module carrier 11 is fastened to the bottom side 10*a* of the base plate 10. In particular, it is fastened thereto by a first adhesive bond 26. The first adhesive bond 26 may be a double-sided adhesive tape.

The module carrier 11 preferably contains a receptacle 27. In this receptacle 27 a function module that is separate thereto can be attached. The function module here is preferably a light module 28. The light module 28 contains a light housing 29 with a diffusor 30. Moreover, it contains a circuit board 31 with at least one light source 32. The light source 32 may for instance be a light-emitting diode. The light module 28 may be fastened by a releasable connection in the receptacle 27. For instance, this may be a fixing connection 33.

In an embodiment, the module carrier 11 may contain an, in particular integrated, light panel as example for a glare protection cover 34. Same extends freely cantilevering downward and is arranged in the depth direction in front of the light module 28. Thus, an emission of light of the light module obliquely towards the bottom and towards the front is prevented at least in part. Blinding a viewer looking from the front at the separation unit 7 is thereby avoided. As can also be discerned in FIG. 3, the receptacle 27 contains an light opening 35 that is oriented towards the bottom, in particular a light exit opening.

Moreover, the separation unit 7 contains first bearing part 36 and second bearing part 37 (FIG. 2). On these bearing parts 36 and 37 in an embodiment bearing elements may be arranged, by which the separation unit 7 may be releasably beared on the vertical side walls 8 and 9. Bearing parts 36 and 37 may equally be fastened by adhesive bonds 38, such as for instance a double-sided adhesive tape, to the bottom side 10*a* of the base plate 10.

In FIG. 3 moreover a cable 39 with a plug 40 is exemplarily shown. This cable 39 with the plug 40 may be laid in a cable duct in the module carrier 11.

Figure 4:
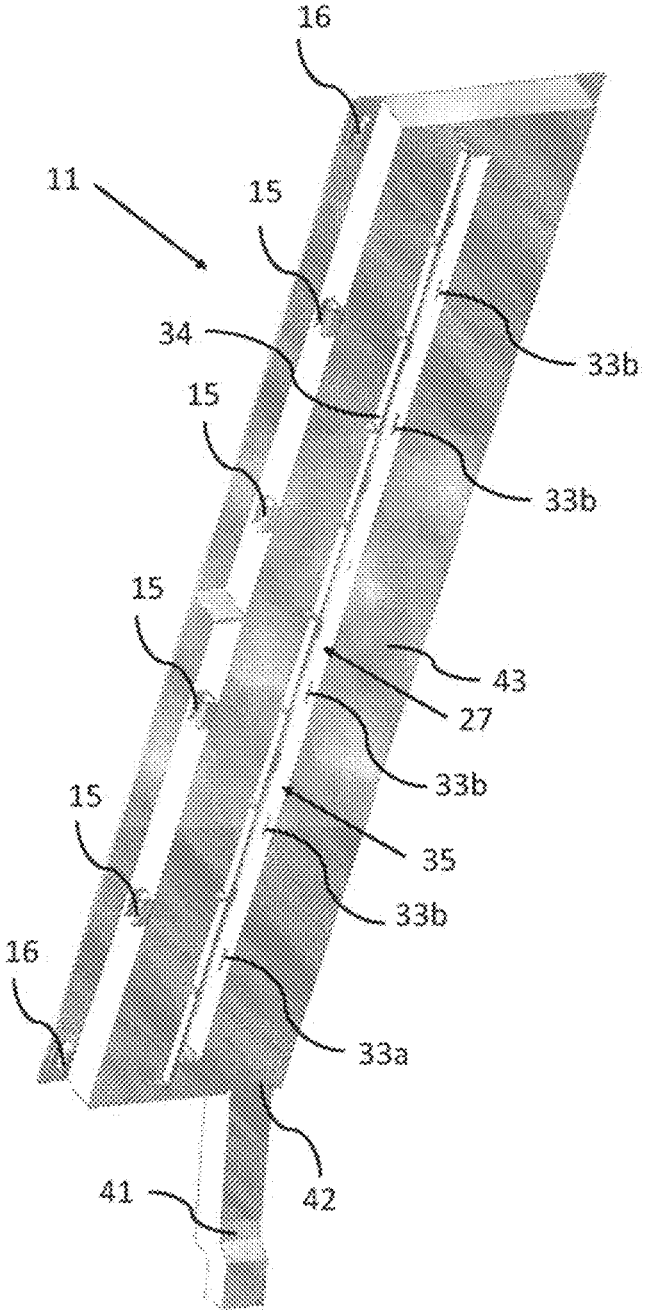
FIG. 4 is a perspective view of an embodiment of a module carrier of the plate-like separation unit according to FIG. 2 and FIG. 3.

In FIG. 4 in a perspective representation, an embodiment of such module carrier 11 is shown. The module carrier 11 may be integrally formed. It may for instance be made of plastic. Conceivably, the module carrier 11 may be of a trough-like design.

In this connection in FIG. 4, it is also shown that the module carrier 11 contains a cable channel or cable duct 41. This cable duct 41 may be configured to be integrally formed with the remaining portion of the module carrier 11. It may be configured to be movable relative thereto. For instance, it may be arranged with a film hinge 42 on the remaining part of the module carrier 11. For instance, the cable 39 with the plug 40 may be laid therein.

In particular, the cable duct 41 is arranged with a film hinge 42 on a, here preferably trough-like, base carrier 43 of the module carrier 11. In particular, it is arranged on a narrow side of the base carrier 43 and laterally protruding from there, so that the cable 39 with the plug 40 may be guided through the cable duct 41 and connected to a counter plug 70 provided directly adjacent to the module carrier 11 in an opening (not shown) of the first side wall 8 and the second side wall 9 of the household cooling appliance 1 (FIG. 1).

Further, in FIG. 4, the module carrier 11 container a light panel as example for a glare protection cover 34. Same extends freely cantilevering downward and is arranged in the depth direction in front of the receptacle 27. The receptacle 27 contains a light opening 35 that is oriented towards the bottom, in particular a light exit opening. On an inner side surface of the receptacle 27 are provided catching structures 33*b*, depressions or grooves for attaching the light module (not shown) in the receptacle 27 of the module carrier 11.

Figure 5:
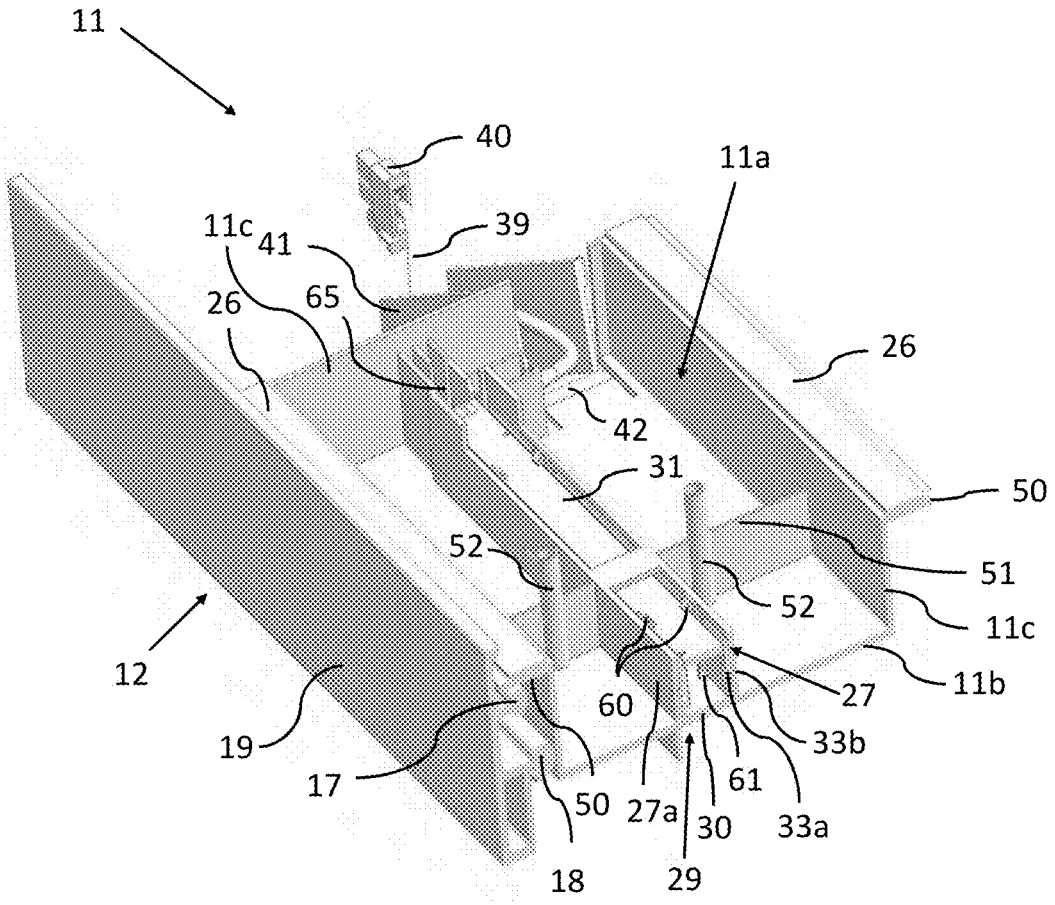
FIG. 5 is perspective view of an embodiment of the module carrier of the plate-like separation unit according to FIG. 2 to FIG. 4.

In FIG. 5 an embodiment of the module carrier 11 of the plate-like separation unit according to FIG. 2 to FIG. 4 is shown in a sectional view. In contrast of the previous representations according to FIG. 2 to 4, it is more details disclosed the fixing connection 33 of the light module 28 and receptacle 27. The fixing connection 33 contains catching structures 33*b* or depressions provided on an inner side surface of the receptacle 27 and latching structures 33*a* or projections, preferably outer detent springs, provided on an outer side surface of the light housing 29. The shape of the catching structures 33*b* or depressions corresponds to the shape of the outer detent springs 33*a*, which is for example hook-shaped in this embodiment. The light housing 29 is pot-shaped and having a bottom wall 30, forming the light transmission plate and is preferably configured as diffusor 30, from which side walls extending upwardly and forming a cavity for receiving the circuit board 31, which is, in the mounted state, latched between inner detent springs 60 facing into the cavity and counter rips 61 provided below the inner detent springs 60 along the inner side surface of the cavity of the pot-shaped light housing 29.

Further, in FIG. 5 is shown a second receiving space 11*a* of the module carrier 11 formed by horizontal boundary wall 11*b* and vertical boundary walls 11*c*. Inside the second receiving space 11*a* is provided a connection cavity 65 for receiving an electrical connector (not shown) of the cable 39 connectable to the electrical connection 31*a* on the small edge of the circuit board 31. The connection cavity 65 may be provided at the small side outside of the light opening 35 of the receptacle 27. In the second receiving space 11*a* of the module carrier 11 are provided spacers 52 for keeping a defined distance to the above attached base plate (not shown) and reinforcement rips 51 for enhancing the stiffness of the module carrier 11, which are preferably integrally formed with the module carrier 11. The spacers 52 extend vertically and are shaped cylindrical. The reinforcement rip 51 extends between the longitudinal sides of the module carrier 11. The module carrier 11 contains horizontal flange surfaces 50 extending along the longitudinal sides of the module carrier 11 and forming a flat surface on which is provided the first adhesive bond 26 for attaching the module carrier 11 to the lower side of the base plate (not shown). At an end portion of the module carrier 11 is provided the cable duct 41. This cable duct 41 may be configured to be integrally formed with the remaining portion of the module carrier 11. It may be configured to be movable relative thereto. For instance, it may be arranged with a film hinge 42 on the remaining part of the module carrier 11. For instance, the cable 39 from the circuit board 31 with the plug 40 may be laid therein and connectable to a counter plug 70 provided directly adjacent to the module carrier 11 in an opening (not shown) of the side wall 8, 9 of the household cooling appliance 1 (FIG. 1).

The light module 28, especially the light housing 29, is insertable into the receptacle 27 through the light opening 35, wherein the light module 28 is positioned in such a manner that the electrical connection of the circuit board 31 of the light module 28 facing the connection cavity 65. The light module 28 is movable inside the receptacle 27 along the longitudinal direction of the receptacle 27 in direction of the connection cavity 65 with the result that the electrical connection of the circuit board 31 of the light module 28 is inserted into the connection cavity 65 and the light module 28 is latched in the receptacle 27 of the module carrier 11. In the latched state, an extension 63 of the bottom wall 30 of the light housing 29 moves into the light opening 35 and covers the remaining opening of the light opening 35 after movement of the light module 28 in longitudinal direction of the receptacle 27 of the module carrier 11. The extension 63 is arranged opposite to the electrical connection 31*a* of the circuit board 31 and is integrally formed with the light housing 29.

Figure 6:
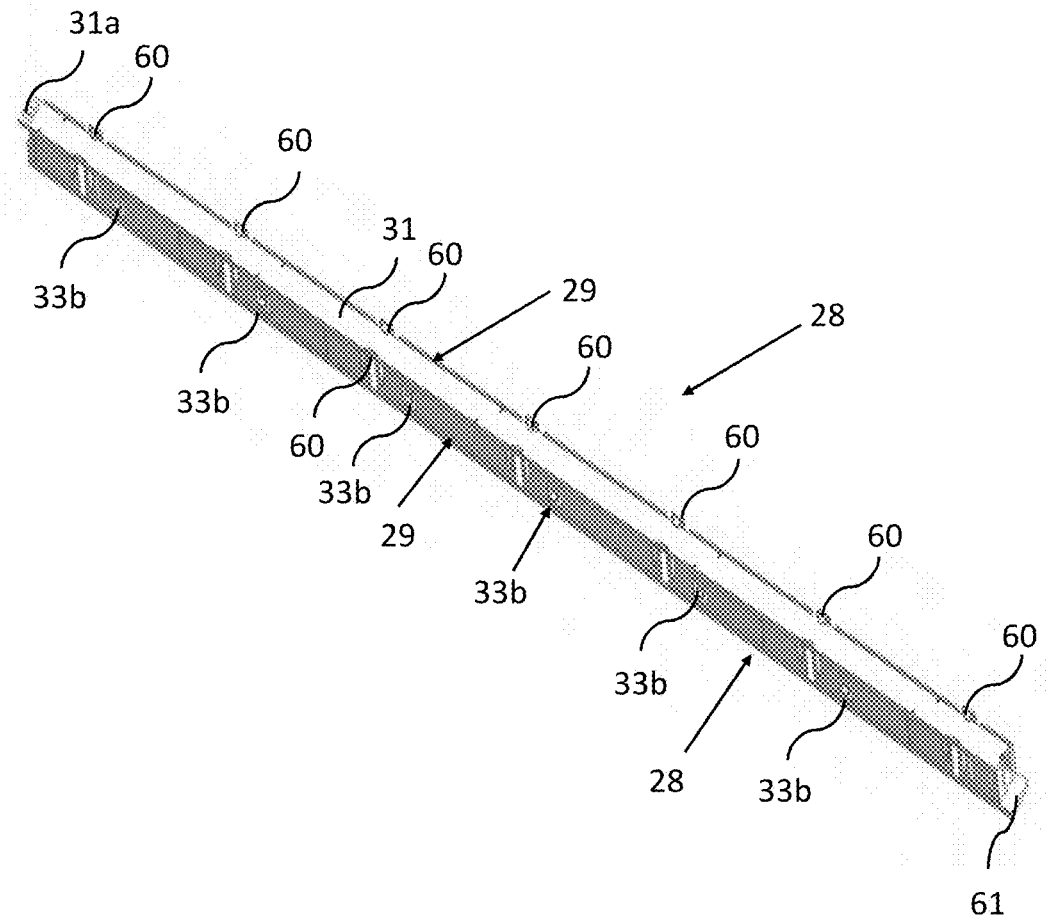
FIG. 6 is a perspective view of an embodiment of a light module according to FIG. 3 and FIG. 5.

In FIG. 6 is shown a perspective representation of an embodiment of a light module 28 according to FIG. 3 and FIG. 5. The light module 28 contains a light housing 29 having a plurality of latching structures 33*a* or outer detent springs arranged along the longitudinal outer side surface of the light housing 29 for fixation with the plurality of catching structures 33*b* or depressions provided on an inner side surface of the receptacle 27 in the latched state of the light module 28 in the receptacle 27 of the module carrier 11. In this embodiment, the latching structures 33*a* are for instance hook-shaped. The light housing 29 is pot-shaped and having a bottom wall 30, forming the light transmission plate and is preferably configured as diffusor 30, from which side walls extending upwardly and forming a cavity for receiving the circuit board 31, which is, in the latched state, latched between inner detent springs 60 facing into the cavity of the light housing 29 and counter rips 61 provided in a distance beneath the inner detent springs 60 along the inner side surface of the cavity of the light housing 29. In the latched state, the circuit board 31 is lying on the counter rips 61 and is held in position by the inner detent springs 60.

Further, in FIG. 6, the bottom wall 30, which is configured as light transmission plate, especially diffusor 30, of the light housing 29 having an extension 63 protruding over the cavity of the light housing 29 and is opposite to an electrical connection 31*a* of the circuit board 31 in order to completely cover the light opening 35 of the receptacle 27 in the latched state of the light housing 29 in the receptacle of the module carrier 11.

The following is a summary list of reference numerals and the corresponding structure used in the above description of the invention:

| | |
|---|---|
| 1 | household cooling appliance |
| 2 | housing |
| 3 | outer housing |
| 4 | inner liner |
| 5 | first receiving space |
| 5a | upper volume subspace |
| 5b | lower volume subspace |
| 6 | door |
| 7 | plate-like separation unit |
| 8 | first side wall |
| 9 | second side wall |
| 10 | base plate |
| 10a | bottom side |
| 11 | module carrier |
| 11a | second receiving space |
| 11b | horizontal boundary wall |
| 11c | vertical boundary wall |
| 12 | front panel |
| 13 | releasable connection |
| 14 | snap-fit connection |
| 15 | first snap-fit claw |
| 16 | second snap-fit claw |
| 17 | first snap-fit bolt |
| 18 | second snap-fit bolt |
| 19 | panel part |
| 20 | first holding fillet |
| 21 | second holding fillet |
| 22 | stabilizing structure |
| 23 | top end bar |
| 24 | front edge |
| 25 | depression |
| 26 | first adhesive bond |
| 27 | receptacle |
| 28 | light module |
| 29 | light housing |
| 30 | diffusor |
| 31 | circuit board |
| 31a | electrical connection |
| 32 | light source |
| 33 | fixing connection |
| 33a | latching structure |
| 33b | catching structure |
| 34 | glare protection cover |
| 35 | light opening |
| 36 | first bearing part |
| 37 | second bearing part |
| 38 | second adhesive bond |
| 39 | cable |
| 40 | plug |
| 41 | cable duct |
| 42 | film hinge |
| 43 | base carrier |
| 50 | flange surface |
| 51 | reinforcement rips |
| 52 | spacer |
| 60 | inner detent spring |
| 61 | counter rip |
| 63 | extension |
| 65 | connection cavity |
| 70 | counter plug |

-continued

| | |
|---|---|
| x | width direction |
| y | height direction |
| z | depth direction |

The invention claimed is:

1. A household cooling appliance, comprising:

a housing defining a first receiving space for receiving food; and a plate-shaped separation unit releasably disposed in said first receiving space and is disposed for separation of a volume of said first receiving space, wherein said plate-shaped separation unit has:

a base plate with a bottom side;

a function module;

a fixing connection;

a module carrier disposed on said bottom side of said base plate for receiving said function module and having a receptacle, said function module is a light module and said light module is releasably disposed to be sunk in said receptacle of said module carrier at least in part and is held therein by said fixing connection; and a bar-shaped front panel with a releasable connection, said module carrier disposed for receiving said bar-shaped front panel being separate from said base plate and being held by said releasable connection to said module carrier.

2. The household cooling appliance according to claim 1, wherein said releasable connection contains a snap-fit connection.

3. The household cooling appliance according to claim 2, wherein said snap-fit connection contains at least one snap-fit claw, into which a snap-fit bolt of said snap-fit connection is snap-fitted.

4. The household cooling appliance according to claim 3, wherein said at least one snap-fit claw is integrated on said module carrier and said snap-fit bolt is integrated on said bar-shaped front panel.

5. The household cooling appliance according to claim 1, wherein said base plate is a glass plate.

6. The household cooling appliance according to claim 1, wherein said module carrier has a flange surface, said module carrier is fastened to said bottom side by a first adhesive bond disposed along said flange surface of said module carrier.

7. The household cooling appliance according to claim 6, wherein said first adhesive bond is a double-sided adhesive tape.

8. The household cooling appliance according to claim 1, wherein said light module has a light housing and a circuit board, on said circuit board at least one light source is disposed, wherein said circuit board is disposed in said light housing of said light module.

9. The household cooling appliance according to claim 8, wherein said light housing is configured to be translucent or transparent at least in portions.

10. A household cooling appliance, comprising:

a housing defining a first receiving space for receiving food; and a plate-shaped separation unit releasably disposed in said first receiving space and is disposed for separation of a volume of said first receiving space, wherein said plate-shaped separation unit has:

a base plate with a bottom side;

a function module;

a fixing connection; and a module carrier disposed on said bottom side of said base plate for receiving said function module and having a receptacle, said function module is a light module and said light module is releasably disposed to be sunk in said receptacle of said module carrier at least in part and is held therein by said fixing connection, said module carrier on a bottom side having at least one light opening formed therein.

11. The household cooling appliance according to claim 10, wherein on said bottom side of said module carrier adjacent to said at least one light opening a downward glare protection cover is disposed.

12. A household cooling appliance, comprising:

a housing defining a first receiving space for receiving food; and a plate-shaped separation unit releasably disposed in said first receiving space and is disposed for separation of a volume of said first receiving space, wherein said plate-shaped separation unit has:

a base plate with a bottom side;

a function module;

a fixing connection; and a module carrier disposed on said bottom side of said base plate for receiving said function module and having a receptacle, said function module is a light module and said light module is releasably disposed to be sunk in said receptacle of said module carrier at least in part and is held therein by said fixing connection, said module carrier having a cable duct, by which cables are laid externally to said plate-shaped separation unit or from externally to said module carrier.

13. The household cooling appliance according to claim 12, wherein said module carrier has a base carrier and a film hinge, said cable duct is disposed with said film hinge on said base carrier of said module carrier.

14. The household cooling appliance according to claim 8, wherein said light housing is configured as a diffusor at least in part.

15. The household cooling appliance according to claim 10, wherein said at least one light opening is a light exit opening.

16. The household cooling appliance according to claim 10, wherein on said bottom side of said module carrier adjacent to said at least one light opening a downward glare protection cover is integrated.

* * * * *